US008905738B2

(12) United States Patent
Subiantoro et al.

(10) Patent No.: US 8,905,738 B2
(45) Date of Patent: Dec. 9, 2014

(54) REVOLVING VANE EXPANDER HAVING DELIVERY CONDUIT ARRANGED TO CONTROL WORKING FLUID FLOW

(75) Inventors: Alison Subiantoro, Singapore (SG); Ken Shaun Yap, Singapore (SG); Kim Tiow Ooi, Singapore (SG)

(73) Assignee: Nanyang Technological University, Singapore (SG)

( * ) Notice: Subject to any disclaimer, the term of this patent is extended or adjusted under 35 U.S.C. 154(b) by 226 days.

(21) Appl. No.: 13/577,559

(22) PCT Filed: Feb. 9, 2010

(86) PCT No.: PCT/SG2010/000044

§ 371 (c)(1),
(2), (4) Date: Oct. 16, 2012

(87) PCT Pub. No.: WO2011/099933

PCT Pub. Date: Aug. 18, 2011

(65) Prior Publication Data

US 2013/0045124 A1 Feb. 21, 2013

(51) Int. Cl.

| | |
|---|---|
| ***F03C 2/00*** | (2006.01) |
| ***F03C 4/00*** | (2006.01) |
| ***F01C 1/348*** | (2006.01) |
| ***F01C 21/18*** | (2006.01) |
| *F25B 9/06* | (2006.01) |

(52) U.S. Cl.

CPC ..... *F01C 1/348* (2013.01); *F04C 2240/603* (2013.01); *F25B 9/06* (2013.01); *F01C 21/18* (2013.01)

USPC ..... 418/173; 418/15; 418/138; 418/186; 418/259

(58) Field of Classification Search

USPC ..... 418/15, 138, 173, 183, 186, 259

See application file for complete search history.

(56) References Cited

U.S. PATENT DOCUMENTS

| | | | |
|---|---|---|---|
| 1,081,687 | A | 12/1913 | McLane |
| 1,851,193 | A | 3/1932 | Laraque |
| 1,998,604 | A | 4/1935 | Belden |
| 1,941,651 | A | 1/1943 | Behlmer |
| 2,705,591 | A | 4/1955 | Anderson |
| 2,891,482 | A | 6/1959 | Menon |
| 3,125,031 | A | 3/1964 | Rydberg et al. |

(Continued)

FOREIGN PATENT DOCUMENTS

| | | |
|---|---|---|
| DE | 202009000009 | 3/2009 |
| WO | WO 2008004983 | 1/2008 |

OTHER PUBLICATIONS

International Preliminary Report on Patentability for PCT/SG2010/000044, dated Aug. 23, 2012.

(Continued)

*Primary Examiner* — Theresa Trieu

(74) *Attorney, Agent, or Firm* — Carlson, Gaskey & Olds, P.C.

(57) ABSTRACT

An example revolving vane expander includes a cylinder. A rotor is housed within the cylinder to establish a working chamber between the cylinder and the rotor. The rotor is eccentrically mounted relative to the cylinder. A vane is secured to the cylinder or the rotor. The vane is slidably receivable within a slot established in the other of the cylinder or the rotor. The vane is configured to link rotational movement of the cylinder and the rotor.

7 Claims, 10 Drawing Sheets

(56) References Cited

U.S. PATENT DOCUMENTS

| | | | | |
|---|---|---|---|---|
| 3,767,333 | A | 10/1973 | Ashikian | |
| 3,767,335 | A | 10/1973 | Kramer et al. | |
| 4,553,513 | A | 11/1985 | Miles et al. | |
| 4,673,343 | A | 6/1987 | Moore | |
| 5,564,916 | A | 10/1996 | Yamamoto et al. | |
| 6,666,671 | B1 | 12/2003 | Olver et al. | |
| 2007/0280844 | A1 | 12/2007 | Olofsson | |
| 2009/0180911 | A1* | 7/2009 | Ooi et al. | 418/173 |
| 2010/0310401 | A1* | 12/2010 | Ooi et al. | 418/173 |

OTHER PUBLICATIONS

Search Report and Written Opinion mailed on Jun. 17, 2010 for PCT/SG2010/000044.
Subiantoro, A. et al., Int'l Journal of Refrigeration Jan. 21, 2010, vol. 33, pp. 675-685.
Teh Y.L. et al., Int'l Journal of Refrigeration Oct. 9, 2009, vol. 32, pp. 1092-1102.
Search Report and Written Opinion for PCT/SG2008/000058, dated Jul. 7, 2008.
International Preliminary Report on Patentability for PCT/SG2008/000058, dated Mar. 12, 2009.
Kruse, H., "Experimental Investigations on Rotary Vane Compressors, Proceedings of the Purdue Technology Conference", 1982, p. 382-388.
Ma, et al., Dynamic Behavior of Twin-Piece Vane Machine, Transactions of the ASME, vol. 124, 2002, p. 74-78.
Teh, Y. L, Ooi, K. T., Design and Friction Analysis of the Revolving Vane Compressor, Proceedings of the Purdue Compressor Technology Conference, 2006, CO246 (in print).
Ooi, K. T., Teh, Y. L., Geometrical Optimization of the Revolving Vane Compressor, Proceedings of the Purdue Compressor Technology Conference, 2006, C-047 (in print).
Teh, Y. L, Ooi, K. T., Dynamic Model of a Valve Reed with Centrifugal Loading, Proceedings of the IIR/IHRACE Conference., 2006, p. 508-515.
Singapore Search Report and Written Opinion dated Sep. 20, 2012 for Singapore Patent Application No. 201005993-9.
Search Report and Written Opinion for PCT/SG2011/000018 dated Feb. 28, 2011.

* cited by examiner

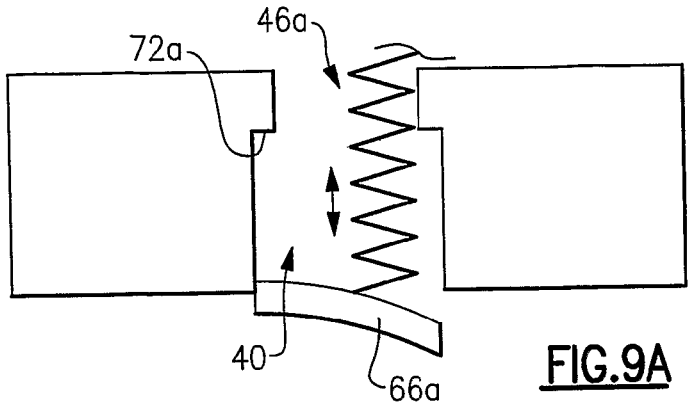
FIG.9A
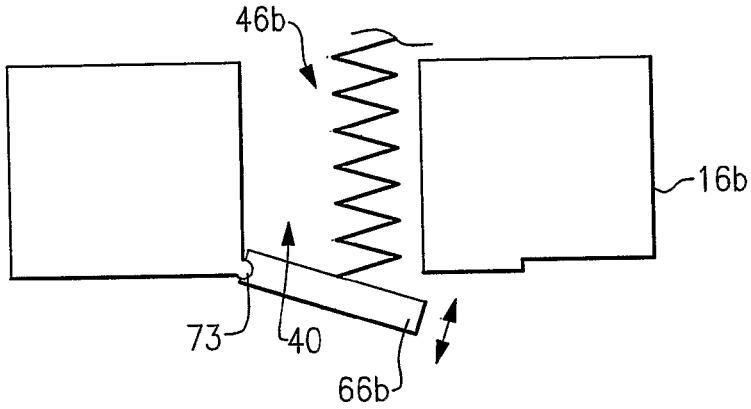
FIG.9B
FIG.11
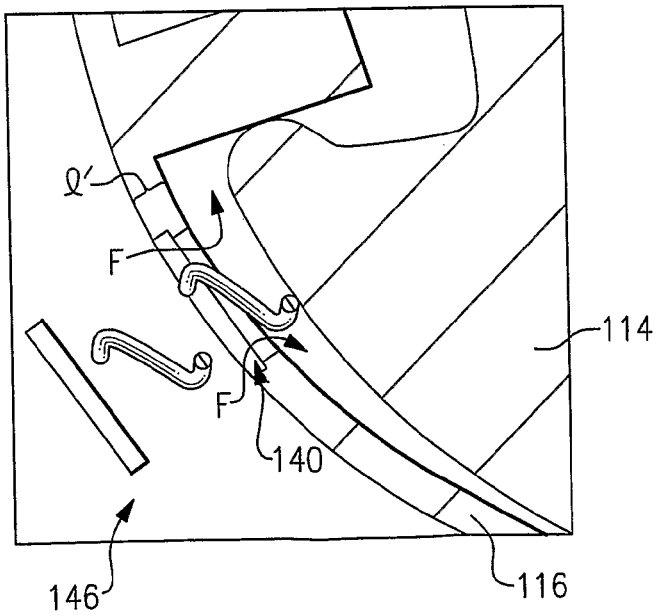

REVOLVING VANE EXPANDER HAVING DELIVERY CONDUIT ARRANGED TO CONTROL WORKING FLUID FLOW

This application is a United States National Phase application of PCT Application No. PCT/SG2010/000044 filed Feb. 9, 2010.

TECHNICAL FIELD

This disclosure relates generally to an expander. In particular, this disclosure relates to a revolving vane expander and controlling flow of an expandable working fluid to a revolving vane expander.

DESCRIPTION OF RELATED ART

As known, expanders recover power from an expandable working fluid, such as a refrigerant. Some refrigerants, such as carbon dioxide, experience a large pressure drop during the expansion process, which can result in undesirable throttling loss. Expanding such refrigerants within an expander can reduce the throttling loss while recovering power. Expanders are often used in combination with a compressor within a refrigeration system, for example. In such a system, the power recovered by the expander can be used to help power a motor of the compressor.

Typical expanders include many components that contact each other during operation. In some designs, a rotor and a vane tip both rub against a stationary cylinder as they move within the cylinder at very high velocities. The rubbing causes undesirable frictional losses.

Many expanders include valves or other structures that control a flow of the expandable working fluid to the expander. Some of these expanders use solenoid valves, which are costly and difficult to incorporate into the expander.

SUMMARY

An example revolving vane expander includes a cylinder. A rotor is housed within the cylinder to establish a working, chamber between the cylinder and the rotor. The rotor is eccentrically mounted relative to the cylinder. A vane is secured to the cylinder or the rotor. The vane is slidably receivable within a slot established in the other of the cylinder or the rotor. The vane is configured to link rotational movement of the cylinder and the rotor.

Another example revolving vane expander includes a cylinder establishing a suction port. A rotor is housed within the cylinder to establish a working chamber between the rotor and the cylinder. The suction port is configured to communicate fluid to the working chamber. At least one valve assembly is moveable between a first position and a second position. The first position permits more fluid to flow through the suction port to the working chamber than the second position. A vane is secured to the cylinder or the rotor. The vane is slidably receivable within a slot established in the other of the cylinder or the rotor. The vane is configured to link rotational movement of the cylinder and the rotor.

Another example revolving vane expander includes a rotor housed within a cylinder to establish a working chamber between the rotor and the cylinder. The working chamber is operative to receive a compressed fluid that is communicated to the working chamber through a suction port. A vane is secured to one of the cylinder or the rotor. The vane is slidably receivable within a slot established in the other of the cylinder or the rotor. The vane is configured to link rotational movement of the cylinder and the rotor. The expander also includes a blocker. Rotating the cylinder moves the suction port between a first position relative to the blocker and a second position relative to the blocker. The first position permits more compressed fluid to flow through the suction port to the working chamber than the second position.

Another example revolving vane expander includes a cylinder rotatable about an axis. A rotor housed within the cylinder establishes working chamber between the rotor and a radially inner surface of the cylinder. The working chamber is operative to receive and expand a working fluid. A vane is secured to one of the cylinder or the rotor. The vane is slidably receivable within a slot established in the other of the cylinder or the rotor. The vane is configured to link rotational movement of the cylinder and the rotor. A delivery conduit is arranged to control flow of the working fluid. The delivery conduit has conduit opening. Rotating the rotor moves the conduit opening between a first position and a second position. The first position permits more of the working fluid to flow through the conduit than the second position.

Another example revolving vane expander includes a cylinder establishing a suction port. A rotor is housed within the cylinder to establish working chamber between the rotor and the cylinder. The suction port is configured to communicate fluid through the cylinder to the working chamber. A vane is secured to one of the cylinder or the rotor. The vane is slidably receivable within a slot established in the other of the cylinder or the rotor. The vane is configured to link rotational movement of the cylinder and the rotor. A valve assembly is moveable between a first position and a second position. The first position permits more fluid to flow through the suction port to the working chamber than the second position. The valve assembly is biased toward the second position. A guide member establishes a track having a varied axial distance from the rotational axis of the cylinder. The valve assembly is slidably received within the rack to move the valve assembly between the first position and the second position as the cylinder rotates.

These and other features of the example disclosure can be best understood from the following specification and drawings, the following of which is a brief description:

BRIEF DESCRIPTION OF THE DRAWINGS

FIG. 9A is a close-up view of another example valve assembly for use in the FIG. 1 expander assembly.

FIG. 9B is a close-up view of yet another example valve assembly for use in the FIG. 1 expander assembly.

FIG. 11 is a close-up view of an example valve assembly for use in the FIG. 6 expander assembly.

DETAILED DESCRIPTION

Figure 1:
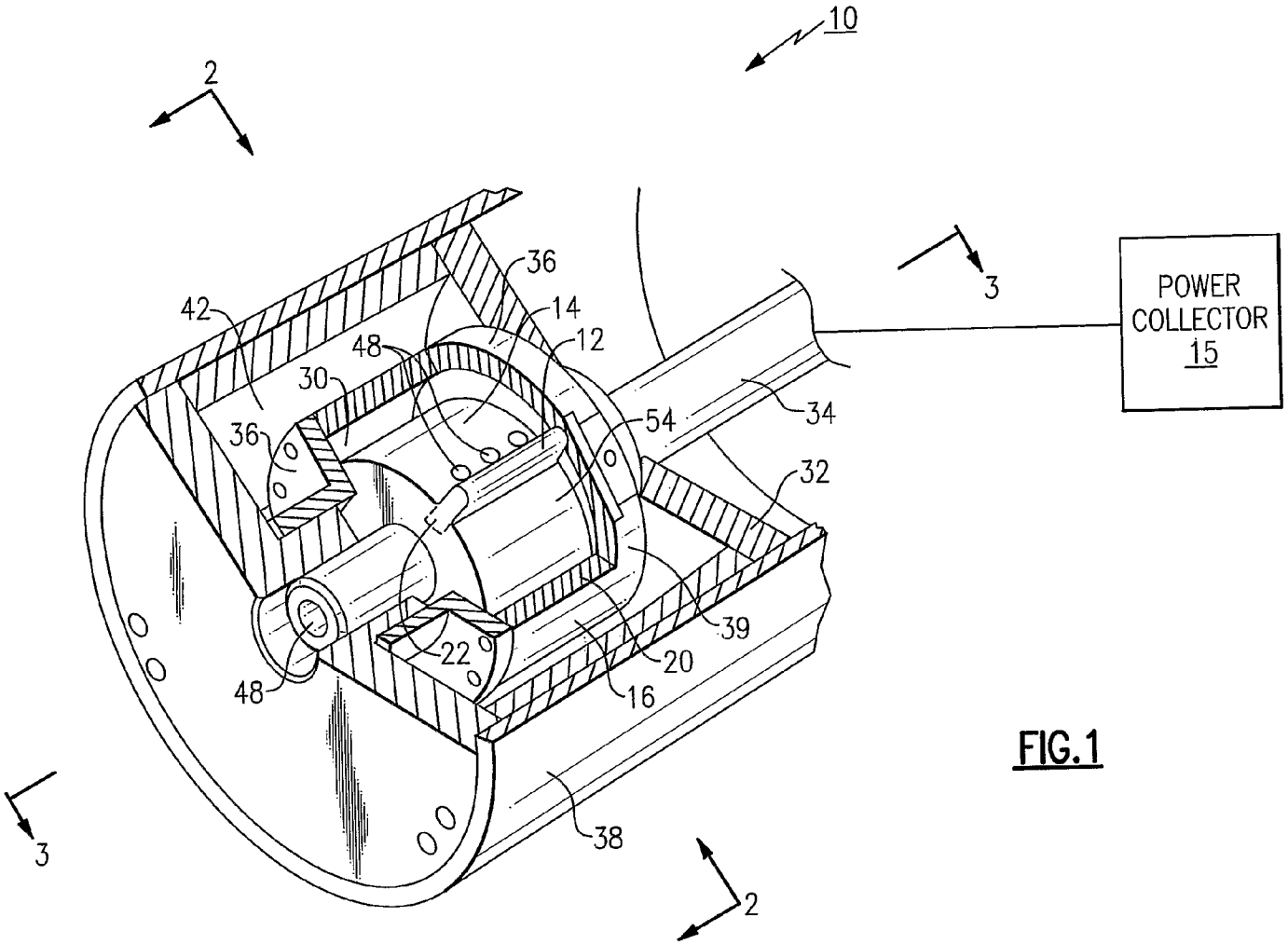
FIG. 1 shows a partially cutaway perspective view of an example expander assembly having a vane fixed to a rotor.
Figure 2:
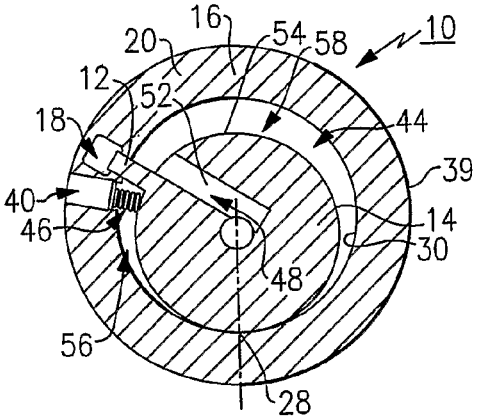
FIG. 2 is a partial section view at line 2-2 of FIG. 1.
Figure 3:
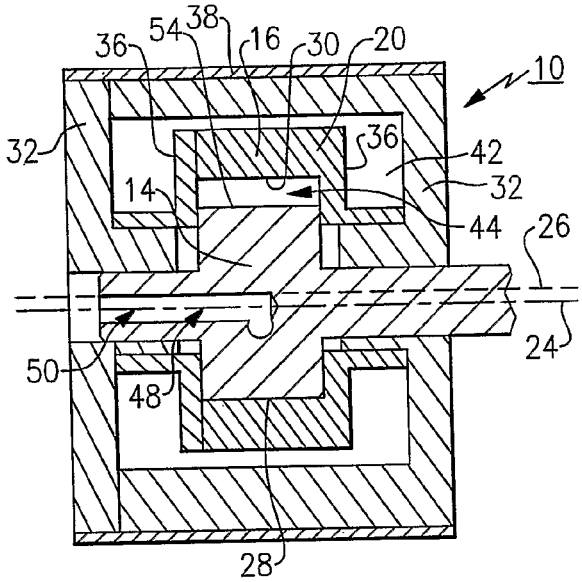
FIG. 3 is a section view at line 3-3 of FIG. 1.

As shown in FIGS. 1-4, an example revolving vane expander 10 includes a vane 12, a rotor 14, and a cylinder 16. The cylinder 16 has a larger diameter than the rotor 14. The vane 12 and the rotor 14 are housed in the cylinder 16.

The vane 12 is slidably received within a slot 18 established in a side wall 20 of the cylinder 16. A base 22 of the vane 12 is rigidly attached to the rotor 14.

The rotor 14 is mounted for rotation about a first longitudinal axis 24 and the cylinder 16 is mounted for rotation about a second longitudinal axis 26. The two axes 24 and 26 are parallel and spaced apart such that the rotor 14 and the cylinder 16 are assembled with an eccentricity. During rotation of the rotor 14 and the cylinder 16 in the example expander 10, a line contact 28 always exists between the rotor 14 and an inner surface 30 of the side wall 20.

The rotor 14 and the cylinder 16 are supported individually and concentrically by journal bearing pairs 32. The rotor 14 and the cylinder 16 are able to rotate about their respective longitudinal axes 24 and 26 supported by journal bearing pairs 32. The example bearings 32 are illustrated in the simply-supported type arrangement. In another example, the bearings 32 are arranged in the cantilever-type arrangement (see FIG. 7).

A shaft 34 is operatively connected to, or integrated with, the rotor 14 and is preferably co-axial with the rotor 14. The shaft 34 is configured to be coupled to a power collector 15 (e.g., a dynamo), a prime mover (e.g., a compressor motor), or both.

Rotation of the vane 12 rotates the cylinder 16 when the vane 12 contacts the sides of the slot 18. The rotation of the rotor 14 and the vane 12 is caused, at least in part, by the expansion and discharge of a working fluid that is contained between the rotor 14 and the cylinder 16.

The cylinder 16 has flanged end plates 36 that may be integral with the side wall 20, or may be separate components securely attached to the side wall 20. The end plates 36 also rotate as the entire cylinder 16, including the side wall 20, rotates.

The example expander 10 includes a shell 38 that surrounds an outer surface 39 of the cylinder 16 and the rotor 14. The shell 38 is stationary, with the cylinder 16 and the rotor 14 configured to rotate within and relative to the shell 38. In this example, the shell 38 is a high pressure shell. In another example, the shell 38 is a low pressure shell.

A suction port 40 is positioned in and through the side wall 20 of the cylinder 16. The suction port 40 is configured to communicate an expandable working fluid from a hollow interior 42 of the pressure shell 38 through the side wall 20 of the cylinder 16 to a working chamber 44 established between the cylinder 16 and the rotor 14. The suction port 40 have a suction valve assembly 46 configured to control flow of the expandable gas through the suction port 40. More than one suction port 40 is used in other examples.

A discharge port 48 is located along the shaft 34 and co-axial with the longitudinal axis 24 of the rotor 14. The discharge port 48 is operatively connected to a discharge pipe (not shown). The discharge port 48 has a first portion 50 that extends axially within the shaft 34 and one or more second portions 52 that extend radially within the rotor 14. The second portions 52 terminate at an outer surface 54 of the rotor 14. The number of second portions 52 can be varied depending on the use of the expander 10, and the axial extent of the rotor 14.

The vane 12 and the line contact 28 between the rotor 14 and the cylinder 16 separates the working chamber 44 into a suction chamber 56 and a discharge chamber 58. The suction port 40 communicates the working fluid into the suction chamber 56. The working fluid is discharged from the discharge chamber 58 through the discharge port 48.

Figure 4:
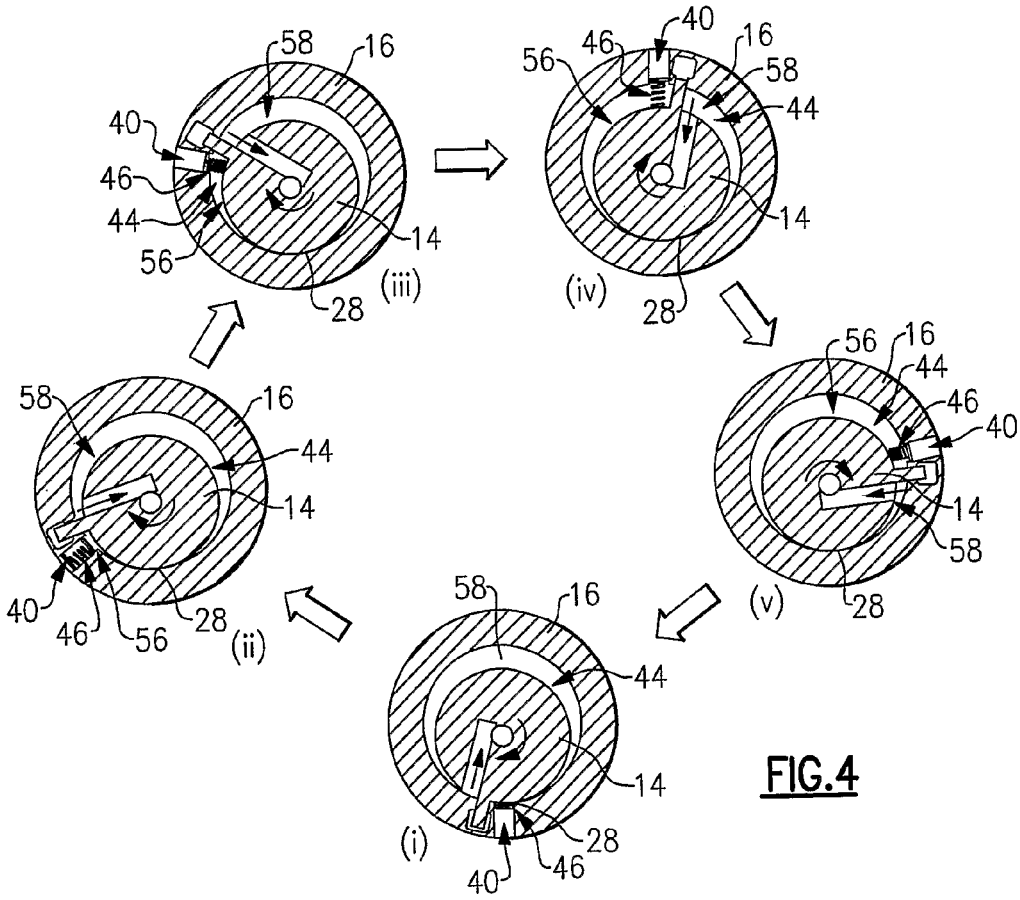
FIG. 4 is a series of illustrations showing selected stages of a working cycle for the FIG. 1 expander assembly.

Referring to FIG. 4(*i*), the expander 10 is shown in a position corresponding to the beginning of a suction-discharge phase. In this position, the expandable fluid is drawn into the suction chamber 56 through the suction port 40, and expanded fluid is discharged from the discharge chamber 58 though the discharge port 48.

In FIG. 4(*ii*), the suction-discharge phase continues as more of the expandable fluid is drawn into the suction chamber 56 and more of the expanded fluid is discharged through the discharge port 48.

In FIG. 4(*iii*), the expander 10 is shown in a position corresponding to the beginning of the expansion-discharge phase. In this position, the suction valve assembly 46 blocks flow of the expandable fluid to the suction chamber 56. Expanding the working fluid within the suction chamber 56 increases the size of the suction chamber 56 and urges the expander 10 to rotate in the direction shown. Discharge of the expanded fluid continues during step (iii).

In FIG. 4(*iv-v*), expansion and discharge of the working fluid continues. The expansion of the working fluid drives rotation of the rotor 14 in this example. The rotor 14 forces the cylinder 16 to rotate with the rotor 14 through the vane 12.

In another example, the expansion of the working fluid drives rotation of the cylinder 16. In such an example, the rotation of the cylinder 16 forces the rotor 14 to rotate through the vane 12.

The vane 12 slides radially relative to the slot 18 as the rotor 14 rotates relative to cylinder 16. From an external, fixed frame perspective the cylinder 16 does not show an eccentric movement. The line contact 28 between the cylinder 16 and the rotor 14, however, effectively moves around the inner surface 30 of the side wall 20 once every complete revolution of the cylinder 16 and the rotor 14.

Figure 5:
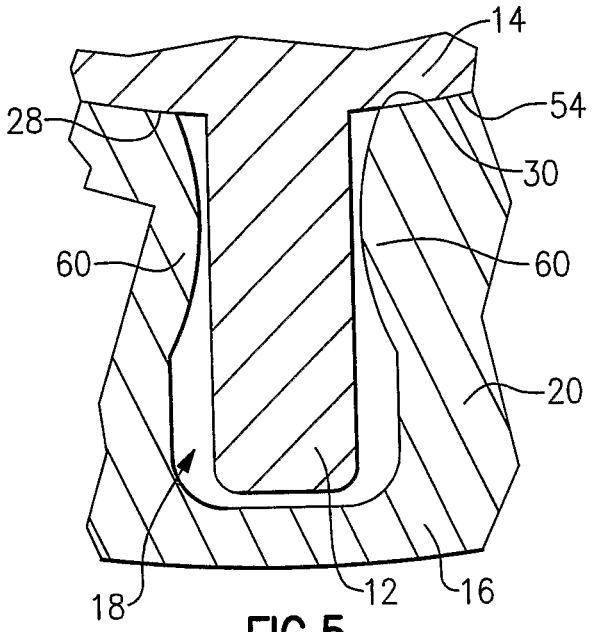
FIG. 5 is a close-up view of a slot of the FIG. 1 expander assembly.

Referring to FIG. 5, the example vane 12 is orientated radially relative to the rotational center of the rotor 14, and the example slot 18 is oriented radially relative to the rotational center of the cylinder 16. Other examples include a non-radial vane received in a non-radial slot.

The vane 12 slides relative to the slot 18 in the cylinder 16. The example slot 18 includes raised areas 60 extending toward the vane 12 from the walls of the slot 18. The raised areas 60 are configured to contact the vane 12 during rotation. The thickness of the vane 12 is less than the circumferential distance between the raised areas 60, which facilitates moving the vane 12 within the slot 18. The raised areas 60 also facilitate movement of the vane 12 relative to the slot 18 because the vane 12 slides over the raised areas 60 rather than over the entire wall of the slot 18, which reduced friction between the vane 12 and the slot 18.

Figure 5A:
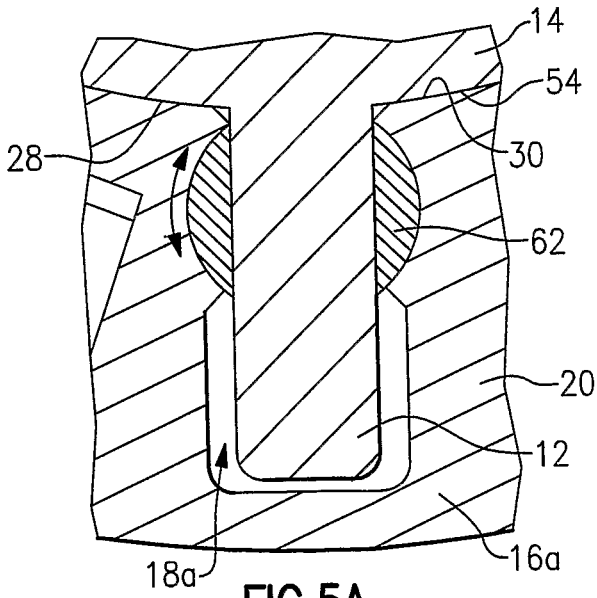
FIG. 5A is a close-up view of another example slot for use with the FIG. 1 expander assembly.

FIG. 5A shows another example cylinder 16*a* having a slot 18*a* incorporating a hinge joint 62 instead of the raised areas 60 of FIG. 5. The hinge joint 62 is rotatable relative to other portions of the slot 18 during rotation of the rotor 14 and the cylinder 16*a*. The hinge joint 62 rotation accommodates radial and circumferential movement of the vane 12 relative to the slot 18.

Figure 6:
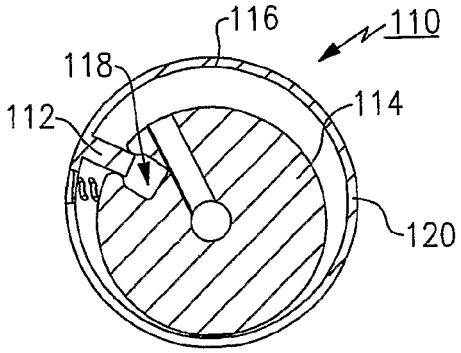
FIG. 6 shows a partial radial section view of another example expander assembly having a vane fixed to a cylinder.
Figure 7:
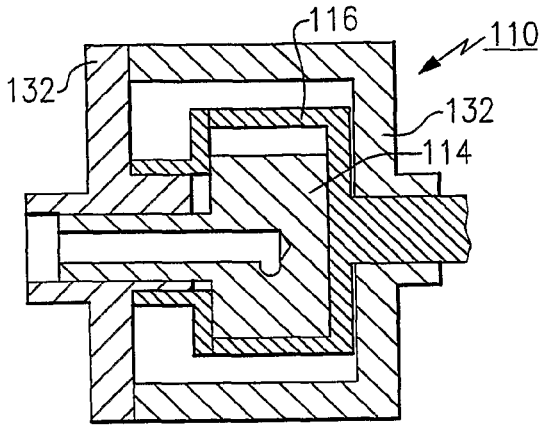
FIG. 7 is an axial section view of the FIG. 6 expander assembly.
Figure 8:
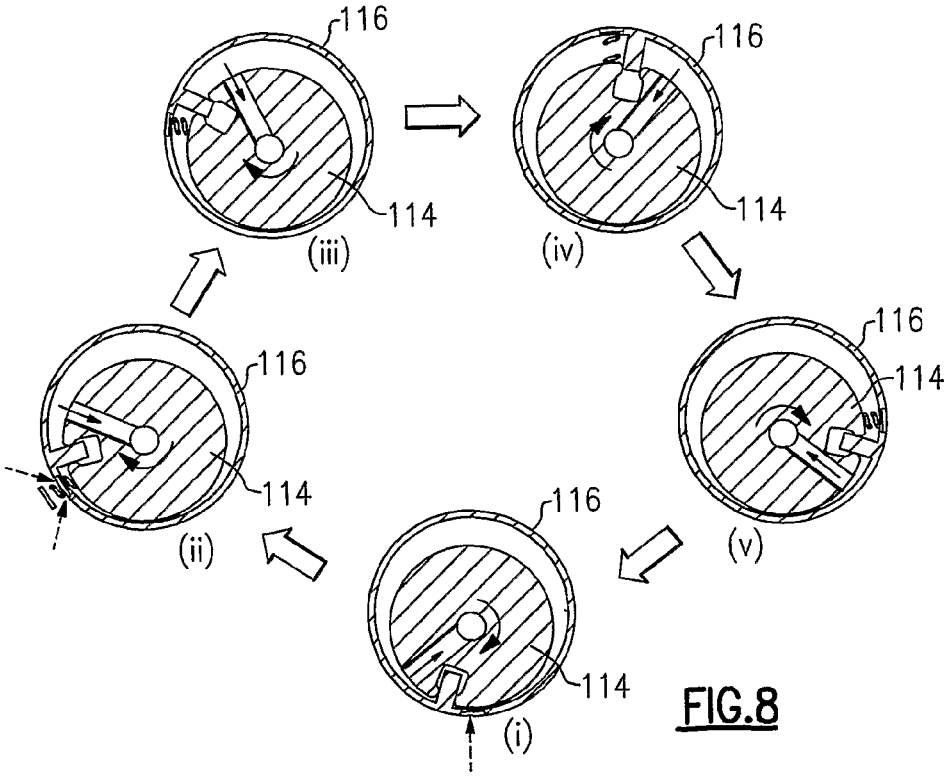
FIG. 8 is a series of illustrations showing selected stages of a working cycle for the FIG. 6 expander assembly.

Referring now to FIGS. 6-8, another example expander 110 includes a vane 112 that is rigidly attached to a cylinder 116 and slides relative to a rotor 114 within a slot 118 of a rotor 114. In such an example, the expansion of the working fluid drives rotation of the cylinder 116 and the vane 112. The rotating vane 112 forces the rotor 114 to rotate with the cylinder 116.

In another example, the vane 112 is rigidly attached to the cylinder 116, and the expansion of the working fluid drives rotation of the cylinder 116. The rotor 114 is then forced to rotate with the cylinder 116 through the vane 112.

In some examples, the cylinder 116 includes holes (not shown) extending through a side wall 120 to reduce inertia of the cylinder 116. Utilizing such holes can make the inertia of the cylinder 116 comparable to the rotational inertia of the rotor 114.

The rotor 114 and the cylinder 116 are supported individually and concentrically by journal bearing pairs 132. In this example, the journal bearing pairs 132 have a cantilever-type arrangement. It is, however, possible that a simply supported bearing arrangement to be used.

Figure 9:
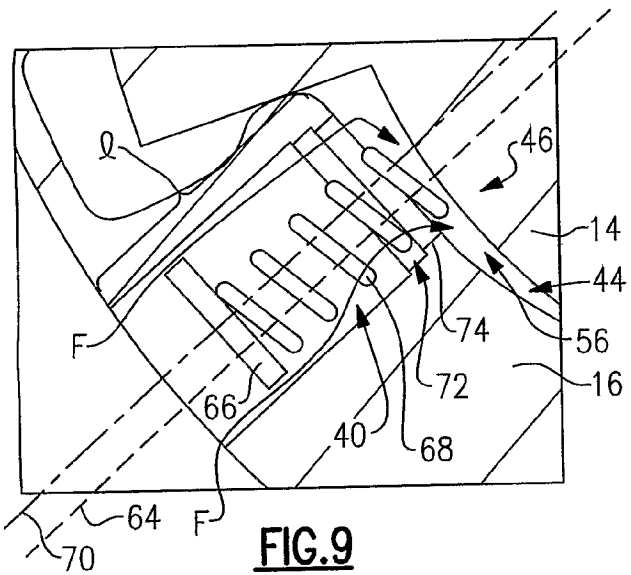
FIG. 9 is a close-up view of an example valve assembly for use in the FIG. 1 expander assembly.

Referring now to FIG. 9 with reference to FIGS. 1-4, the suction valve assembly 46 of the example expander 10 is moveable between an open position and a closed position. In this example, the suction valve assembly 46 allows the working fluid to flow through the suction port 40 to the suction chamber 56 when the suction valve assembly 46 is in the open position. The suction valve assembly 46 blocks flow of working fluid through the suction port 40 to the suction chamber 56 when the suction valve assembly 46 is in the closed position.

The example suction valve assembly 46 moves along the axis 64 from a closed position to an open position at the start of the expansion cycle, which is shown in FIG. 4(*i*). In another example, the suction valve assembly 46 moves from a closed position to an open position later in the cycle.

The example suction valve assembly 46 includes a valve plate 66 and a spring 68. One end of the spring 68 is attached to the valve plate 66. The other end of the spring 68 is attached to the rotor 14. The spring 68 moves the valve plate 66 along the axis 64 to help open and close the suction valve assembly 46.

In this example, the suction port 40 extends along a suction port axis 70. The suction port 40 has a length l. Notably, the axial length of the spring 68 is slightly longer than the length l of the suction port 40.

The suction port 40 includes a valve seat 72, which is an area of the suction port 40 that has a narrower radial diameter than the valve plate 66. The valve plate 66 rests against the valve seat 72 when the suction valve assembly 46 is in the closed position. The valve plate 66 is spaced from the valve seat 72 when the suction valve assembly 46 is in the open position, as shown in FIG. 9. In the open position, the working fluid F flows around the valve plate 66, past the valve seat 72, and through a narrowed portion 74 of the suction port 40 into the suction chamber 56. The narrowed portion 74 has a smaller diameter than the valve seat 12. In one example, the geometries of the suction port 40, such as the valve seat 72, are established using a casting and boring process.

The axis 64 of the spring 68 is circumferentially spaced from the suction port axis 70. In this example, offsetting the axes 64 and 70 ensures that the suction valve assembly 46 moves to the open position only after the suction process starts.

Figure 10:
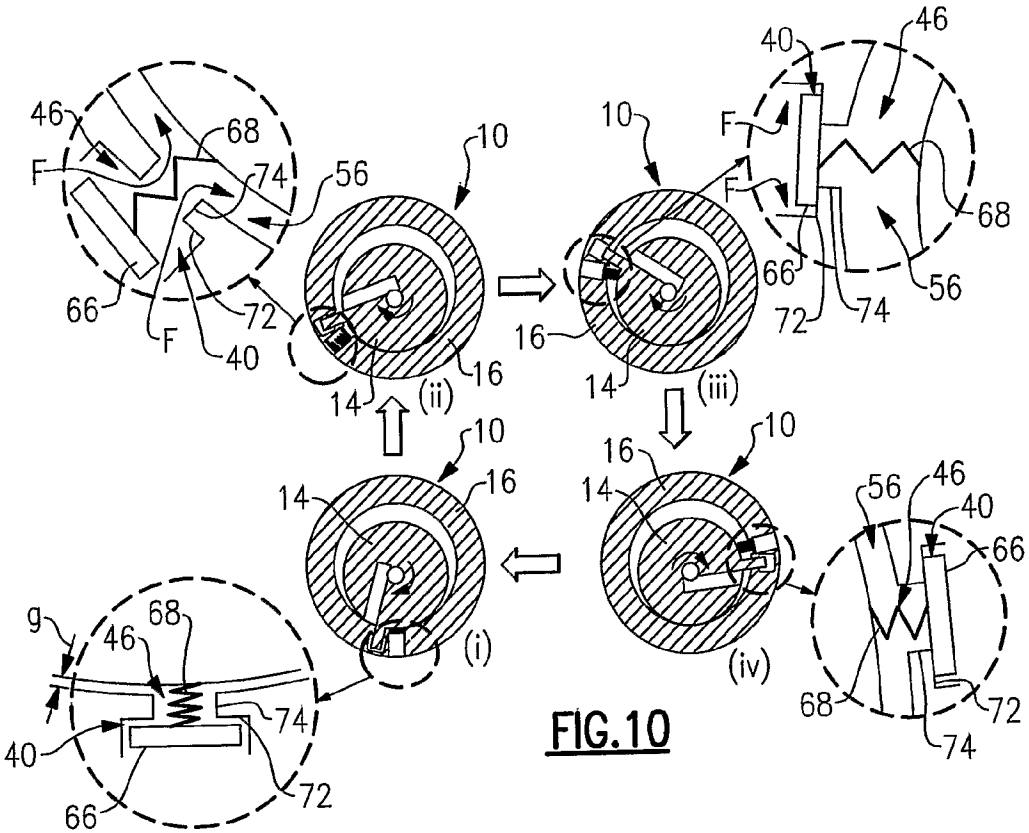
FIG. 10 is a series of illustrations showing positions of the FIG. 9 valve at selected stages of a working cycle for the FIG. 1 expander.

The position of the rotor 14 relative to the cylinder 16 at the start of the suction process is shown in FIG. 10(*i*). In this position, the example spring 68 is fully compressed and a gap g between the rotor 14 and the inner surface 30 is virtually zero. The spring 68 then forces the suction valve assembly 46 to move toward the open position shown in FIG. 10(*ii*). The working fluid F flows into the suction chamber 56 past the valve plate 66, which lessens the pressure difference across the valve plate 66 enabling the spring 68 to move the valve plate 66 even further from the valve seat 72.

The spring 68 eventually reaches its neutral condition and the size of the gap g continues to increase as the gap between the rotor 14 and the cylinder 16 in the area of the suction valve assembly 46 keeps increasing. In this example, the neutral condition length of the spring 68 is equal to the maximum gap g during the expansion cycle plus the length l of the suction port 40. The maximum gap g is shown in FIG. 10(*iii*) in this example. At this point, the suction valve assembly 46 is in a closed position because the valve plate 66 is contacting the valve seat 72. When the valve plate 66 is in this position, the working fluid F exerts pressure against the valve plate 66, which is greater than any force exerted by the spring 68 forcing the valve plate 66 away from the valve seat 72. The pressure difference maintains the position of the valve plate 66 against the valve seat 72 (as shown in FIG. 10(*iv*) until the gap g again decreases and the spring 68 is compressed enough to force the valve plate 66 away from the valve seat 72.

The example spring 68 is designed such that the spring 68 exerts enough force to move the valve plate 66 away from the valve seat 72 to an open position when the spring 68 is fully compressed.

Other examples of the valve plate 66 include balls, cones, etc. The dimensions of the suction port 40 can be adjusted to accommodate these other examples. Other examples of the suction valve assembly 46 include additional springs, dampers, or both to control the valve plate 66.

Referring to FIG. 9A, another example suction valve assembly 46*a* uses a valve plate 66*a* made of a flexible reed. Flexing the valve plate 66*a* and moving the valve plate 66*a* against a valve seat 72*a* moves the suction valve assembly 46*a* between an open position and a closed position to control flow of the working fluid through the suction port 40.

Referring to FIG. 9B, another example suction valve assembly 46*b* uses a valve plate 66*b* that is attached to a cylinder 16*b* at a pivot 73. Pivoting the valve plate 66*b* moves the suction valve assembly 46 between an open position and a closed position to control flow of the working fluid through the suction port 40.

Referring to FIG. 11 with reference to FIGS. 6-8, the expander assembly 110 includes a valve assembly 146. In this example, the length l' of a suction port 140 in the expander assembly 110 is less than the length l of the suction port 40 in the FIG. 9 embodiment. In another example, the length l of suction port 40 is about the same as the length l' of a suction port 140. The lengths l and l' depend, in part, on the wall thickness of the cylinders 16 and 116.

Figure 12:
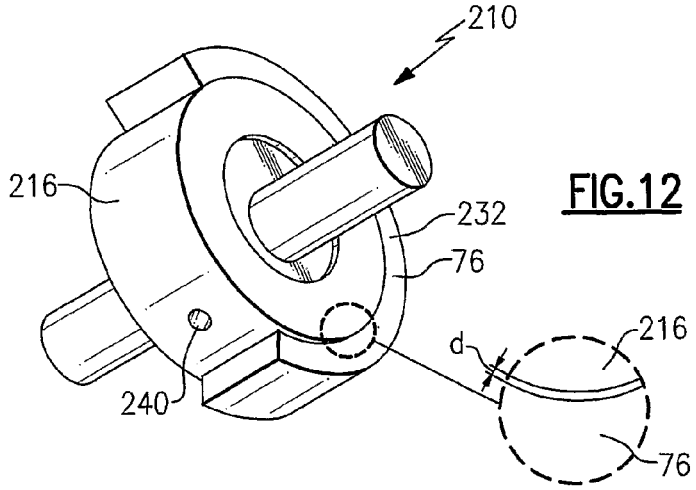
FIG. 12 is a schematic view of an expander assembly having an example blocker.
Figure 13:
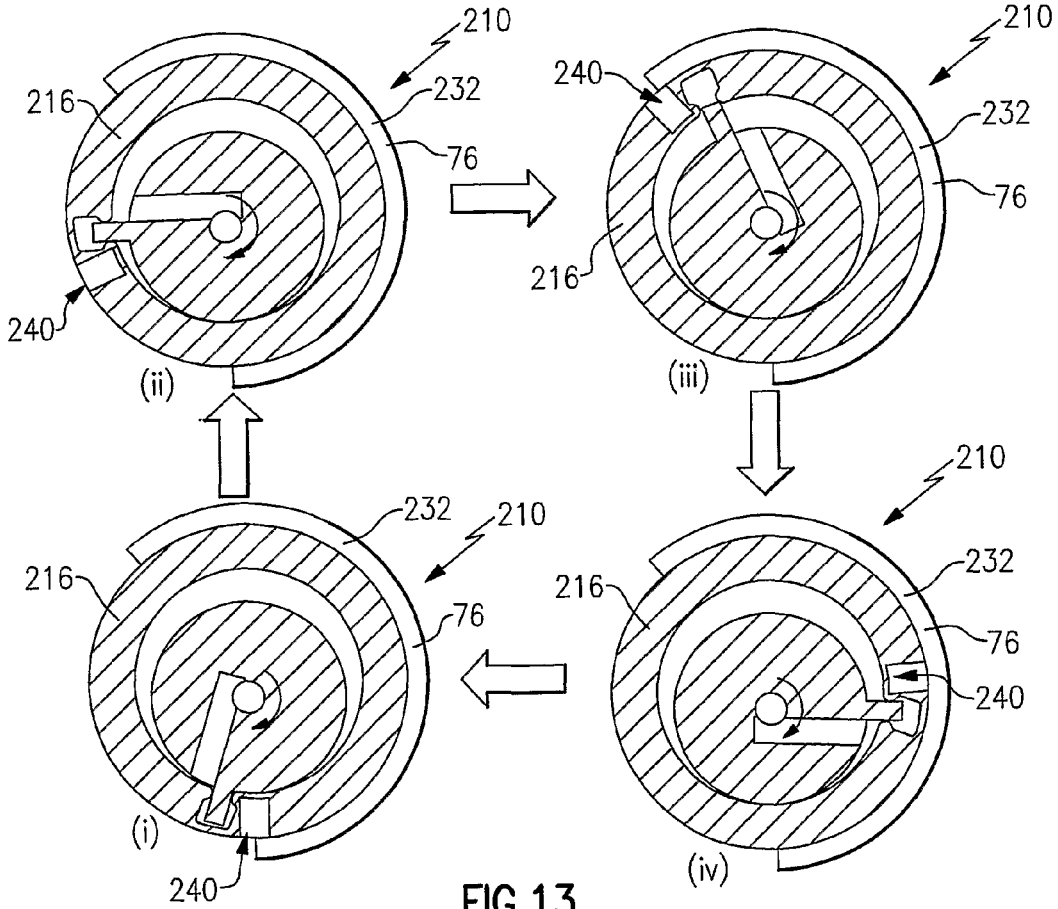
FIG. 13 is a series of illustrations showing positions of the FIG. 12 blocker assembly at selected stages of a working cycle for the FIG. 12 expander assembly.

Referring to FIGS. 12-13, an example expander assembly 210 uses a blocker 76 to control flow of the expandable fluid through a suction port 240 in a cylinder 216. The example blocker 76 remains stationary relative to the cylinder 216 and the rotor 214 as the expander assembly 210 operates. The blocker 76 extends circumferentially around a portion of the cylinder 216, and is configured to block flow of the working fluid through the suction port 240 when radially aligned with the suction port 240. FIG. 13(*iv*) shows the blocker 76 in a position relative to the suction port 240 that blocks flow of the working fluid through the suction port 240. FIGS. 13(*i-iii*) show the blocker 76 in a position relative to the suction port 240 that permits flow of the working fluid through the suction port 240.

The example blocker 76 is arc-shaped and radially spaced a distance d from the cylinder 216. Spacing the blocker 76 relative to the cylinder 216 reduces frictional contact between the blocker 76 and the cylinder 216. The space is minimized to limit leakage of the working fluid. In one example, lubrication is added to the area between the blocker 76 and the cylinder 216. The lubrication fills the distance d to seal this area of the expander assembly 210.

In one example, the blocker 76 is configured to support the expander assembly 210 and thus serves as a bearing assembly 232 for the expander assembly 210.

Figure 12A:
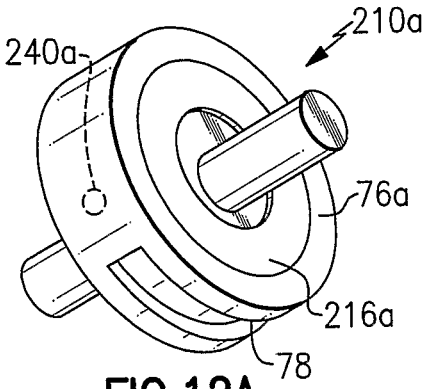
FIG. 12A is a schematic view of another expander assembly having an example blocker.

FIG. 12A shows an example expander assembly 210*a* incorporating a blocker 76*a* that controls flow of the working fluid to the working chamber through the suction port 240*a*. The blocker 76*a* circumferentially surrounds a cylinder 216*a*. A portion of the blocker 76*a* establishes a slot 78. As can be appreciated, the suction port 240*a* is in an open position when the suction port 240*a* is radially aligned with the slot 78.

Figure 12B:
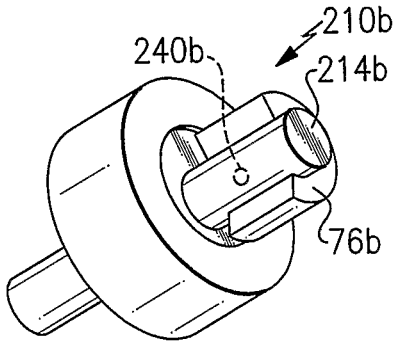
FIG. 12B is a schematic view of yet another expander assembly having an example blocker.

FIG. 12B shows an example expander assembly 210*b* having a blocker 76*b* configured to control flow through a suction port 240*b* established within a rotor 214*b* of the expander assembly 210*b*.

Figure 12C:
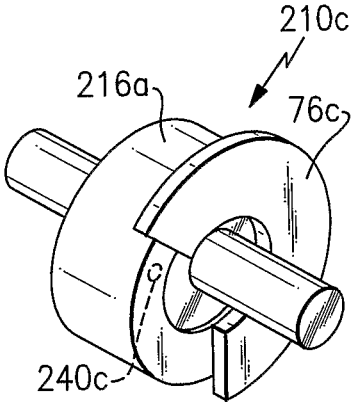
FIG. 12C is a schematic view of yet another expander assembly having an example blocker.

Referring to FIG. 12*c*, another example blocker 76*c* is configured to control flow through an axially extended suction port 240*c* established in a cylinder 216*c* of another example expander assembly 210*c*.

Figure 12D:
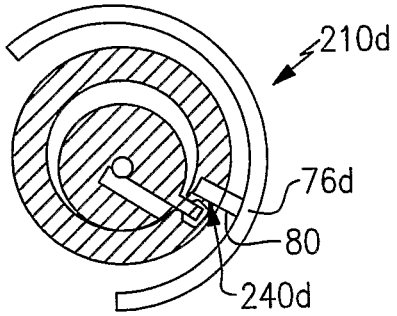
FIG. 12D is a schematic view of yet another expander assembly having an example blocker.

Referring to FIG. 12*d*, another example expander assembly 210*d* includes suction port protrusion 80 extending radially from a suction port 240*d*. The suction port protrusion 80 is configured to contact, or almost contact, a blocker 76*d*. The suction port 240*d* is in a position that restricts flow of the working fluid into a working chamber of the expander assembly 210*d* when the suction port protrusion 80 is axially aligned with the blocker 76*d*. The suction port protrusion 80 effectively extends the axial length of the suction port 240. Utilizing the suction port protrusion 80 reduces frictional losses associated with contact between the blocker 76*d* and the cylinder 16 in one example.

Figure 12E:
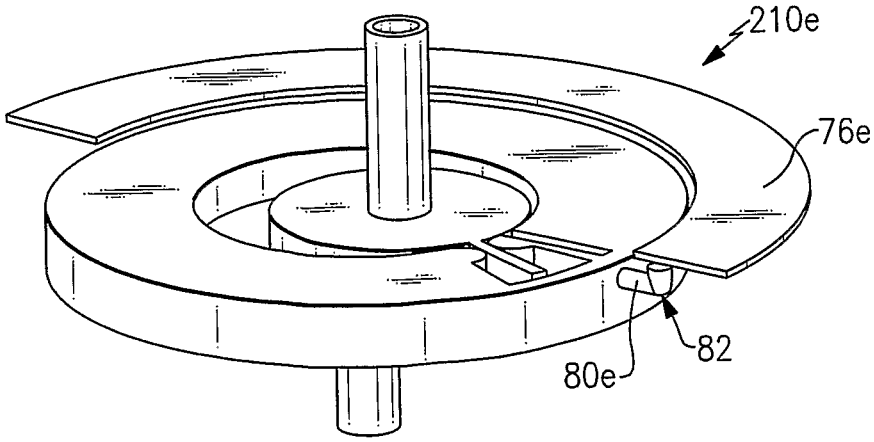
FIG. 12E is a schematic view of yet another expander assembly having an example blocker.
Figure 14:
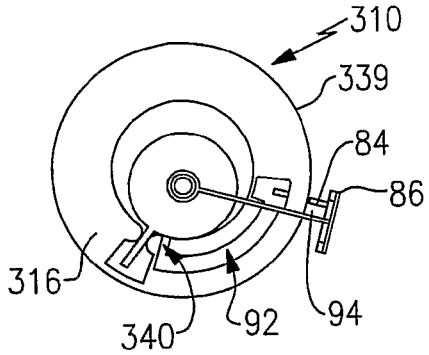
FIG. 14 is a partially cutaway top view of an example expander assembly having a delivery conduit.
Figure 16:
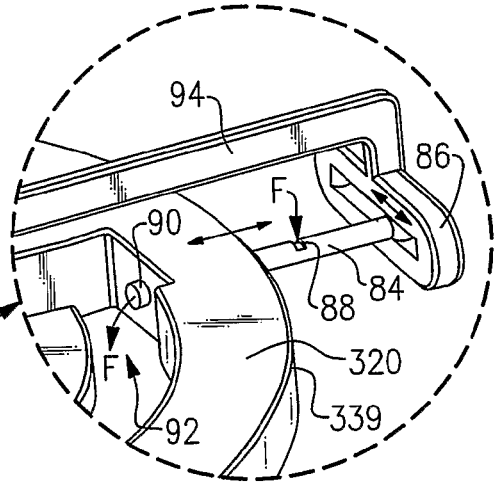
FIG. 16 is a close-up view of the delivery conduit in the FIG. 14 expander assembly.
Figure 15:
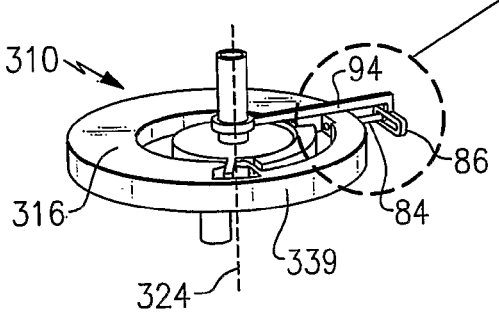
FIG. 15 is a perspective view of the FIG. 14 expander assembly.

FIG. 12*e* shows yet another example expander assembly 210*e* incorporating a suction port protrusion 80*e*. In this example, the suction port protrusion 80*e* includes an axially directed portion 82 configured to contact a blocker 76*e* along a radial plane.

Referring to FIGS. 14-17, an example expander assembly 310 utilizes a delivery conduit 84 and a slider assembly 86 to control flow of the working fluid to a working chamber 344 of the expander assembly 310. The working fluid communicates away from the delivery conduit 84 through a conduit opening 90. A second opening 88 is configured to communicate the working fluid to the delivery conduit 84. The cylinder 316 of the expander assembly 310 includes a tunnel 92 configured to communicate the working fluid from the conduit opening 90 of the delivery conduit 84 to a suction port 340 within the cylinder 316. The suction port 340 delivers the working fluid to the working chamber 344.

The second opening 88 of the example delivery conduit 84 is only able to receive the working fluid when the second opening 88 is radially outside an outer wall 339 of the cylinder 316. As the expander assembly 310 operates, the delivery conduit 84 moves between a position where the second opening 88 is radially outside the outer wall 339 and a position where the second opening 88 is radially inside the outer wall 339. When the second opening 88 is inside the outer wall 339, a side wall 320 of the cylinder 316 blocks the working fluid from entering the second opening 88.

An arm 94 includes a first end having the slider assembly 86 and a second end coupled with, or adjacent to, a rotor 314 such that the arm 94 rotates with the rotor 314 about an axis aligned with a rotational axis 324 of the rotor 314. The delivery conduit 84 moves radially relative to the cylinder 316 as the cylinder 316 rotates eccentrically relative to the rotor 314. The radial movements move the second opening 88 between the first position and the second position.

The slider assembly 86 slidably receives an end of the delivery conduit 84 to accommodate some circumferential movement of the delivery conduit 84 during operation of the expander assembly 310.

Figure 17:
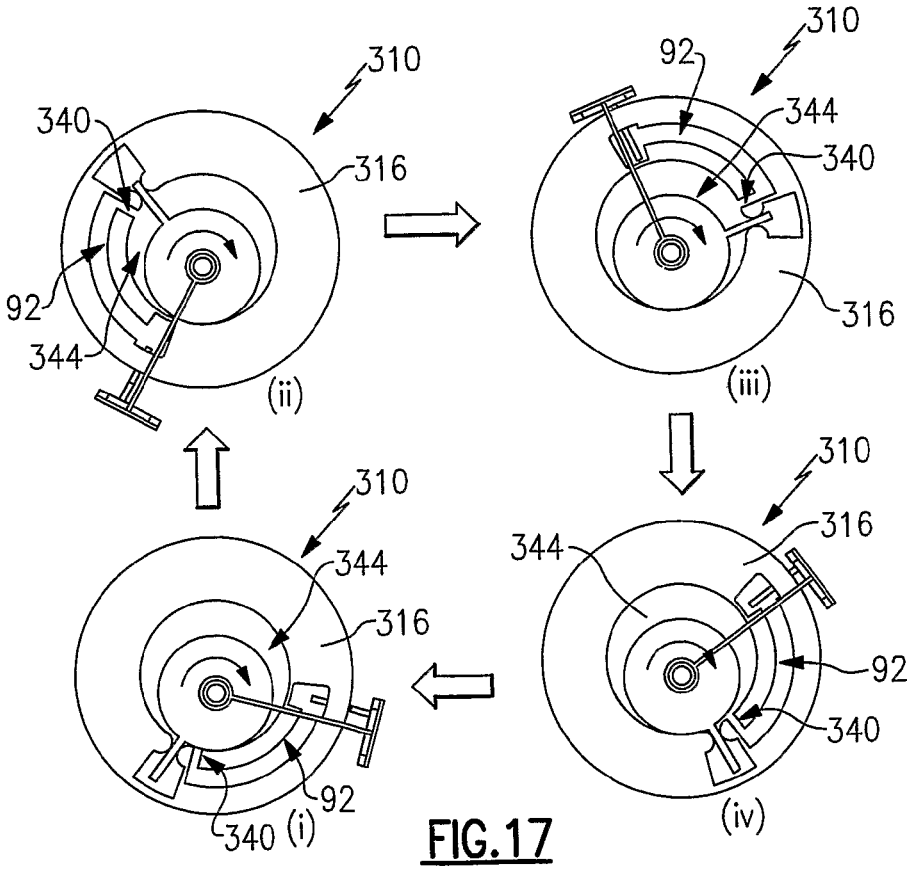
FIG. 17 is a series of illustrations showing the positions of the delivery conduit at selected stages of the working cycle for the FIG. 14 expander assembly.
Figure 18:
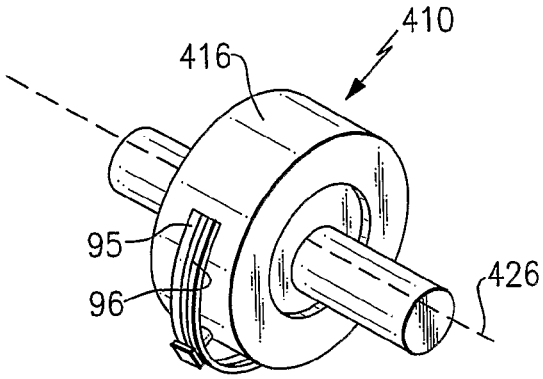
FIG. 18 is a perspective view of an example expander assembly having a guide member and a valve.
Figure 19:
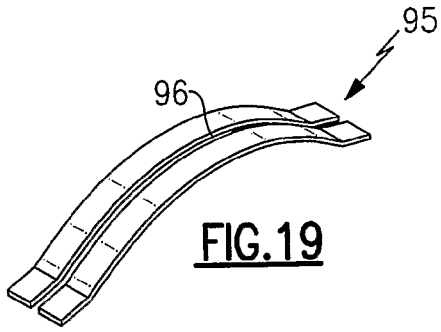
FIG. 19 is a close-up perspective view of the guide member of the FIG. 18 expander assembly.
Figure 20:
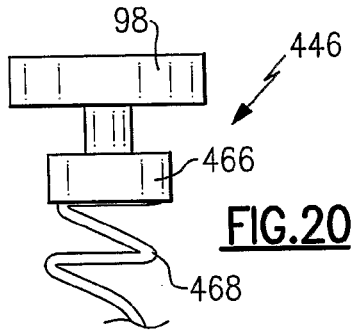
FIG. 20 is a close-up side view of the valve of the FIG. 18 expander assembly.

Selected stages during rotation of the expander assembly 310 are shown in FIG. 17. The delivery conduit 84 is in a closed position in FIGS. 17(*iii-iv*). The delivery conduit 84 is in an open position in FIGS. 17(*i-ii*).

Other types of the delivery conduit 84 are used in other examples, such as a solid rod, a ball, a cone, a plate, a spring plate, etc.

Referring to FIGS. 18-21, an example expander assembly 410 includes a guide member 95 that establishes a track 96. The example guide member 95 is stationary relative to a cylinder 416 of the expander assembly 410 as the cylinder 416 rotates. The axial distance between the track 96 and a rotational axis 426 of the cylinder 416 varies circumferentially.

A suction valve 446 includes a cap 98 attached to a valve plate 466. The cap 98 is spaced from the valve plate 466. The suction valve 446 also includes a spring 468. One end of the spring 468 is attached to the valve plate 466. An opposite end of the spring 468 is attached relative to the suction port 440 at the cylinder 416. The geometry of the suction port 440 is similar to the example suction port 40 of FIG. 9. The spring 468 is attached using screws, welding processes, etc.

The spring 468 is biased to pull the valve plate 466 radially inward toward the rotational axis 426 to a position that blocks flow of working fluid to a working chamber 444 of the expander 410.

Figure 21:
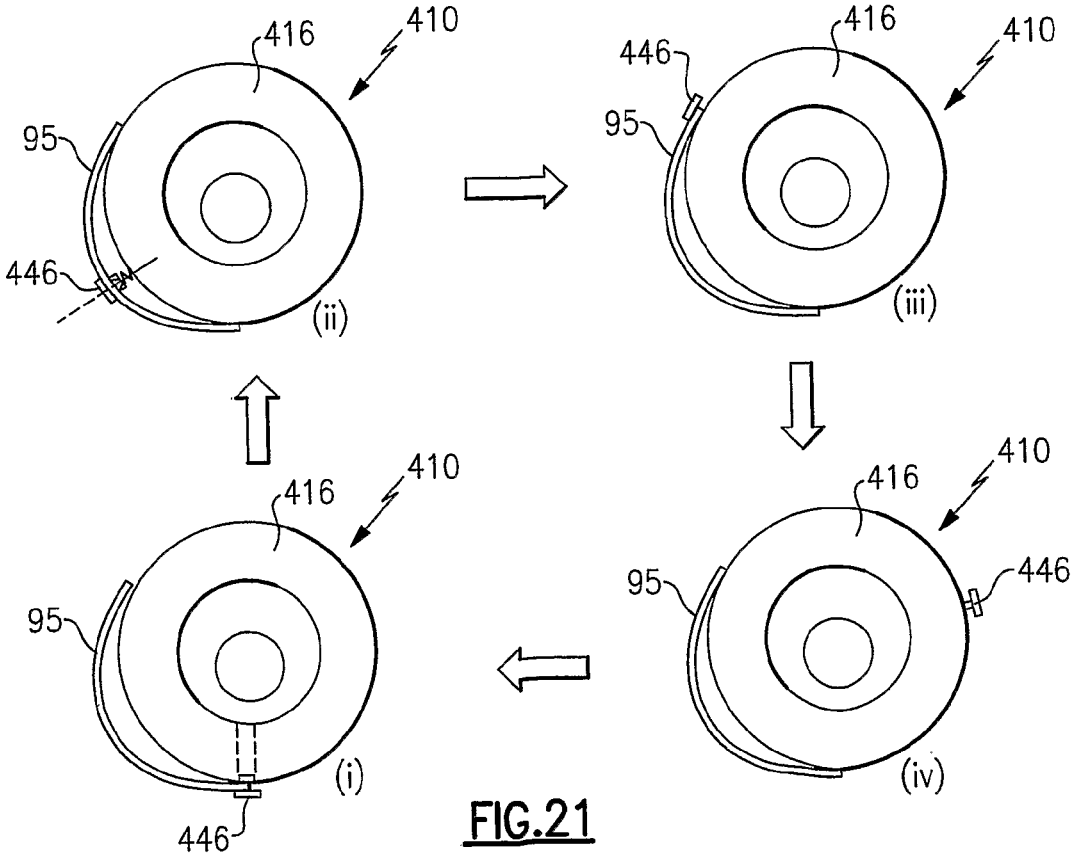
FIG. 21 is a series of illustrations showing the positions of the valve at selected stages of the working cycle for the FIG. 18 expander.

The suction valve 446 moves with the cylinder 416 as the cylinder 416 rotates. The suction valve 446 moves through the track 96 of the guide member 95 during at least a portion of the rotation of the cylinder 416. FIG. 21(*i*) shows the expander 410 in a position where the guide member 95 begins to engage and move the suction valve 446 to an open position. FIG. 21(*ii*) shows the suction valve 446 in a fully open position. In FIG. 21(*iii*) the suction valve 446 travels through a radially inward tapered portion of the guide member 95, which allows the spring 468 to begin to move the suction valve 446 to a closed position. FIG. 21(*iv*) shows the suction valve 446 in a fully closed position where the guide member 95 is not opposing the force of the spring 468 on the suction valve 446.

In another example, a magnet is used to manipulate the position of the suction valve assembly 446 rather than the guide member 95.

Although various embodiments have been disclosed, a worker of ordinary skill in this art would recognize that certain modifications would come within the scope of this invention. For that reason, the following claims should be studied to determine the true scope and content of this invention.

We claim:

1. A revolving vane expander comprising:

a cylinder rotatable about an axis;

a rotor housed within the cylinder to establish a working chamber between the rotor and the radially inner surface of the cylinder, the working chamber operative to receive and expand a working fluid, the rotor being eccentrically mounted relative to the cylinder;

a vane secured to one of the cylinder or the rotor, the vane slidably receivable within a slot established in the other of the cylinder or the rotor, the vane configured to link rotational movement of the cylinder and the rotor; and a delivery conduit arranged to control flow of the working fluid, the delivery conduit having a opening, wherein rotating the rotor moves the opening between a first position and a second position, the first position permitting more of the working fluid to flow through the conduit than the second position.

2. The revolving vane expander of claim 1, including a slider that rotates with the rotor, the slider coupled to the delivery conduit to move the opening between the first position and the second position.

3. The revolving vane expander of claim 1, wherein the delivery conduit is configured to slide relative to the slider about the axis of rotation of the rotor.

4. The revolving vane expander of claim 1, including an arm having a first end and a second end, the first end coupled to a shaft to move the arm with the shaft, the second end coupled to the slider.

5. The revolving vane expander of claim 1, wherein the delivery conduit moves radially relative to the cylinder as the cylinder rotates.

6. The revolving vane expander of claim 1, wherein the opening is a second opening that is radially further from a rotational axis of the rotor than a conduit opening, wherein the delivery conduit is configured to communicate working fluid through the delivery conduit from the second conduit opening to the conduit opening when the second conduit opening is radially outside an outer wall of the cylinder.

7. The revolving vane expander of claim 1, wherein the cylinder has a tunnel configured to communicate the working fluid from the opening to the expansion chamber.

* * * * *